US007262359B1

(12) United States Patent
Edwards, Sr. et al.

(10) Patent No.: US 7,262,359 B1
(45) Date of Patent: Aug. 28, 2007

(54) DIGITAL RECORDING DEVICE FOR ELECTRIC GUITARS AND THE LIKE

(76) Inventors: William L. Edwards, Sr., 251 S. Wing, Wagner, IL (US) 62572; Rodney A. Willis, 227 S. Broad St., Hillsboro, IL (US) 62049

( * ) Notice: Subject to any disclaimer, the term of this patent is extended or adjusted under 35 U.S.C. 154(b) by 259 days.

(21) Appl. No.: 11/158,781

(22) Filed: Jun. 23, 2005

(51) Int. Cl.
*G10H 3/00* (2006.01)

(52) U.S. Cl. ..... 84/723; 84/267; 84/609; 84/742; 84/744; 381/77

(58) Field of Classification Search ..... 84/723, 84/267, 742, 744, 609; 381/77
See application file for complete search history.

(56) References Cited

U.S. PATENT DOCUMENTS 3,550,495 A * 12/1970 Shotmeyer ..... 84/267
3,978,524 A * 8/1976 Gordon et al. ..... 369/1
4,078,464 A * 3/1978 Sugiyama ..... 84/744
4,080,867 A * 3/1978 Ratanangsu ..... 84/477 R
4,790,230 A 12/1988 Sanderson
4,907,483 A * 3/1990 Rose et al. ..... 84/726
5,007,324 A * 4/1991 DeMichele ..... 84/741
5,105,711 A * 4/1992 Barnard ..... 84/744
5,442,986 A * 8/1995 Cota ..... 84/267
5,506,371 A * 4/1996 Gillaspy ..... 84/699
5,767,432 A * 6/1998 Randolph ..... 84/743
5,792,971 A * 8/1998 Timis et al. ..... 84/609
5,837,912 A * 11/1998 Eagen ..... 84/267
5,864,083 A * 1/1999 Caren ..... 84/737
5,889,221 A * 3/1999 Dejima ..... 84/291
5,973,591 A * 10/1999 Schwartz et al. ..... 340/384.7
6,127,615 A * 10/2000 Rosenberg ..... 84/465
6,253,654 B1 * 7/2001 Mercurio ..... 84/267
6,441,293 B1 * 8/2002 LaBarbera ..... 84/723
6,696,632 B2 * 2/2004 Minakuchi et al. ..... 84/735
6,888,057 B2 * 5/2005 Juszkiewicz et al. ..... 84/645
7,081,580 B2 * 7/2006 Brinkman et al. ..... 84/609
7,151,214 B2 * 12/2006 Barry ..... 84/600
7,220,912 B2 * 5/2007 Juszkiewicz et al. ..... 84/742
7,220,913 B2 * 5/2007 Juszkiewicz et al. ..... 84/742
2004/0039463 A1 * 2/2004 Sucher et al. ..... 700/94
2004/0069119 A1 * 4/2004 Juszkiewicz ..... 84/609
2004/0244566 A1 * 12/2004 Steiger ..... 84/610
2004/0264334 A1 * 12/2004 Furuta ..... 369/59.15

(Continued)

FOREIGN PATENT DOCUMENTS

CA 2372014 A1 * 8/2003

*Primary Examiner*—Lincoln Donovan
*Assistant Examiner*—Christina Russell

(57) ABSTRACT

A digital recording device includes a housing that is engageable with a lower curvature of a guitar's frame. The housing includes an arcuate inner surface, an arcuate outer surface coextensively shaped with the inner surface, and a padded member conjoined to the exterior surface thereof. An electrical contact protrudes outwardly from the inner surface and becomes nested with an electromagnetic pickup on the guitar. A mechanism, disposed within the housing, digitally records acoustic signals emanating from the guitar during playing conditions. A rechargeable internal power supply source, situated within the housing, and a timer circuit are linked to the digital recording mechanism. The timer circuit automatically toggles the digital recording mechanism between operative and in-operative modes. A portable base station is mateable to an external power source and is conjoinable to the housing for recharging the internal power supply source.

15 Claims, 5 Drawing Sheets

U.S. PATENT DOCUMENTS

2006/0008093 A1* 1/2006 Hamouie ..... 381/77
2006/0126863 A1* 6/2006 DePasqua ..... 381/79
2006/0159291 A1* 7/2006 Fliegler et al. ..... 381/118
2006/0168142 A1* 7/2006 Juszkiewicz ..... 709/219
2006/0225554 A1* 10/2006 Price, Jr. ..... 84/1
2006/0243123 A1* 11/2006 Ierymenko ..... 84/742
2007/0003073 A1* 1/2007 Iriarte ..... 381/77

* cited by examiner

DIGITAL RECORDING DEVICE FOR ELECTRIC GUITARS AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to digital recording devices and, more particularly, to a digital recording device for electric guitars and the like.

2. Prior Art

Music has nearly always provided a popular source of entertainment and pleasure to persons from all walks of life. This is true whether these individuals are simply listening to another person's music, or playing their own music. A popular instrument among both novice and professional musicians is the guitar. The guitar allows a person to be creative with the chords and riffs that they play in order to create new pleasing sounds.

However, many of these people, particularly musical entertainers, need to be able to easily record new riffs and chords when ever they feel inspired. This has not always been possible, since most recording takes place in a recording studio. In an attempt to alleviate this problem transportable and compact musical recording systems have been developed. Unfortunately, these systems in themselves are very complicated in design and are not readily useable by all individuals. This is especially true for young and old novice players who are not only unable to understand the system and its intricate workings, but they also can not afford to acquire one.

Another disadvantage of conventional and portable recording systems is the poor quality of sound rendered thereby. Because the recording device is spaced a rather considerable distance from the instrument, which in effect is the source of sound, some interference from ambient sounds occurs that distorts the recorder sound. This, unfortunately results in some recorder pieces not sounding true to the original format in which it was played.

Accordingly, a need remains for a digital recording device for electric guitars and the like in order to overcome the above-noted shortcomings. The present invention satisfies such a need by providing a digital recording device that is easy to use, small and compact in design, time- and effort-saving, versatile, practical and convenient. Such a device provides guitarist with a more convenient and user-friendly alternative to conventional analog and digital recording devices.

The digital recording device eliminates the hassles associated with hooking up and configuring conventional multi-track recorders and allows an individual to record ideas at any given moment, which is ideal for capturing those spontaneous and inspired moments of play. Furthermore, the recorded information is easily downloaded to a computer or laptop where it can be easily edited and burned onto a CD. Such a digital recording device for guitars and the like is not only appreciated by professional musicians, but also by novices and music instructors.

BRIEF SUMMARY OF THE INVENTION

In view of the foregoing background, it is therefore an object of the present invention to provide a digital recording device for electric guitars and the like. These and other objects, features, and advantages of the invention are provided by an guitar accessory for recording a player's licks, chords and the like.

The guitar accessory includes a housing sized and shaped for being removably engaged directly with a lower curvature of a guitar's frame. Such a housing includes an arcuate inner surface that extends between top and bottom ends of the housing. The housing has an arcuate outer surface coextensively shaped with the inner surface and equidistantly spaced therefrom for defining an arcuate cavity within the housing. Such a housing further includes a padded member directly conjoined to the exterior surface of the housing for advantageously providing a cushioned barrier between the player and the lower curvature of the guitar.

An electrical contact, that has a rectilinear shape, protrudes outwardly from the inner surface such that the electrical contact effectively becomes operably nested with an electromagnetic pickup located inside the guitar.

A mechanism is included for digitally recording acoustic signals emanating from the guitar during playing conditions such that the acoustic signals can conveniently be digitally stored into a computer readable file. The digital recording mechanism is disposed within the housing. Such a digital recording mechanism preferably includes a microphone directly mated to the electrical contact.

An analog-to-digital converter receives an analog acoustic signal from the microphone and converts the analog acoustic signal to a digital acoustic signal. A digital recorder is directly linked to the analog-to-digital converter. Such a digital recorder receives and stores the digital acoustic signal in a single computer readable digital file. The digital recorder preferably includes a MP3 player. A rechargeable internal power supply source is directly linked to the digital recording mechanism and situated within the housing.

A timer circuit is directly and operably mated to the digital recording mechanism. Such a timer circuit automatically toggles the digital recording mechanism between operative and in-operative modes during playing conditions such that the digital recording mechanism advantageously automatically turns on when the player strokes a string on the guitar and automatically turns off after a predetermined time span.

A portable base station is electrically mateable to an external power supply source. Such a base station is directly conjoinable to the housing in such a manner that the base station effectively recharges the internal power supply source during non-operating conditions.

The base station may further include a digital interface module operably linked to an external computer. Such a digital interface module cooperates with the digital recorder such that the digital file can conveniently be uploaded to the external computer and repeatedly played back as desired by the player. The base station preferably further includes a transformer electrically coupled to the external power supply source and removably engageable with the internal power supply source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
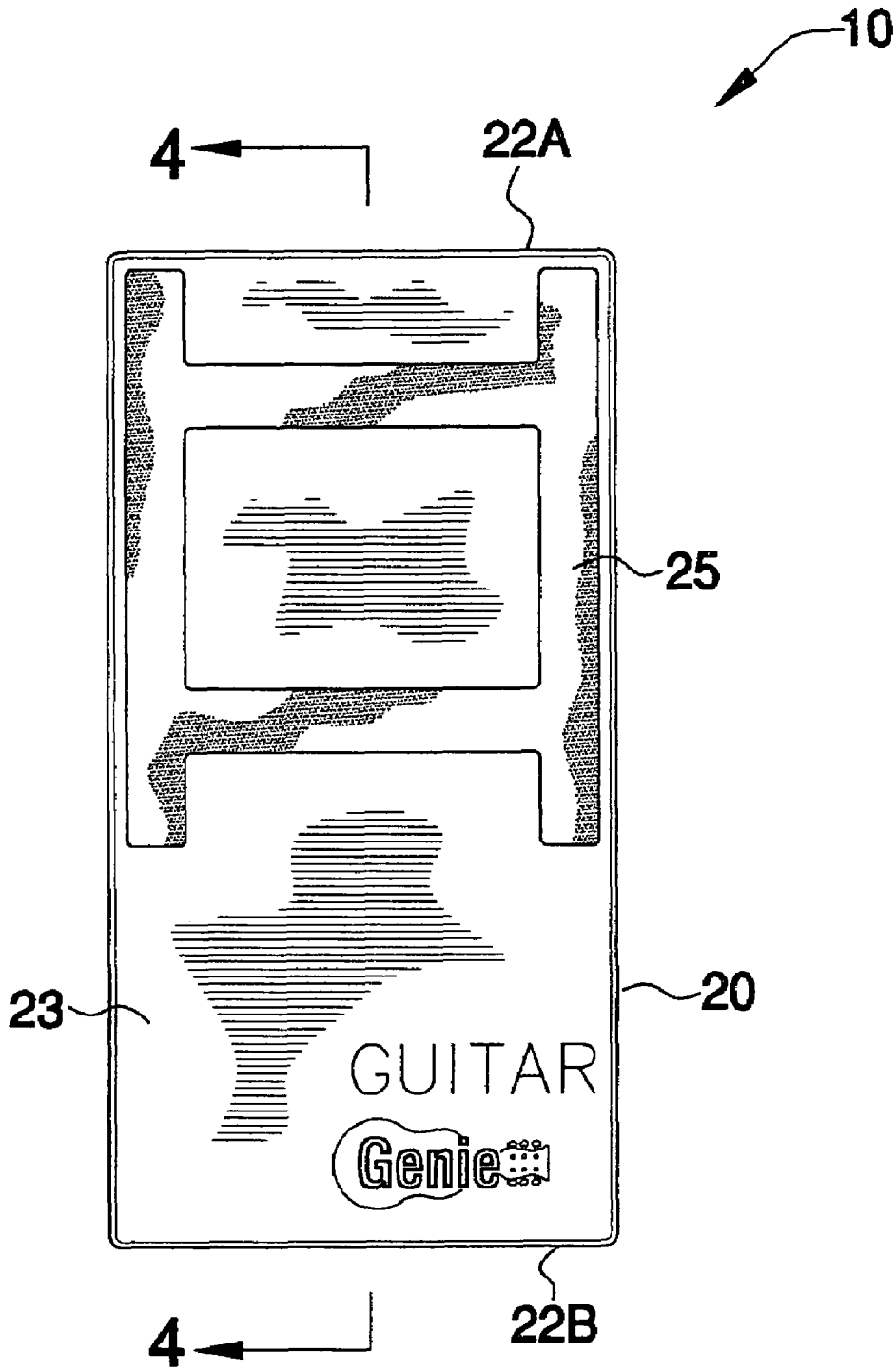
FIG. 1 is a front-elevational view showing a digital recording device for guitars and the like, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a digital recording device for guitars and the like. It should be understood that the device 10 may be used to digitally record many different types of instruments and should not be limited in use to only recording guitar play.

Referring initially to FIG. 1, the device 10 includes a housing 20 sized and shaped for being removably engaged directly with a lower curvature 13 of a guitar's frame 12. Such a housing 20 includes an arcuate inner surface 21 that extends between top 22A and bottom 22B ends of the housing 20. The housing 20 has an arcuate outer surface 23 coextensively shaped with the inner surface 21 and equidistantly spaced therefrom for defining an arcuate cavity 24 within the housing 20. Of course, the housing 20 may be produced in a variety of different shapes, sizes and colors so as to accommodate the various types of guitars found on the market, as is obvious to a person of ordinary skill in the art.

Such a housing 20 further includes a padded member 25 directly conjoined, with no intervening elements, to the exterior surface 23 of the housing 20, which is essential for advantageously providing a cushioned barrier between the player and the lower curvature 13 of the guitar 11. This feature advantageously allows the device 10 to be used for extended periods of time without impeding the user's style of play or becoming uncomfortable.

Figure 2:
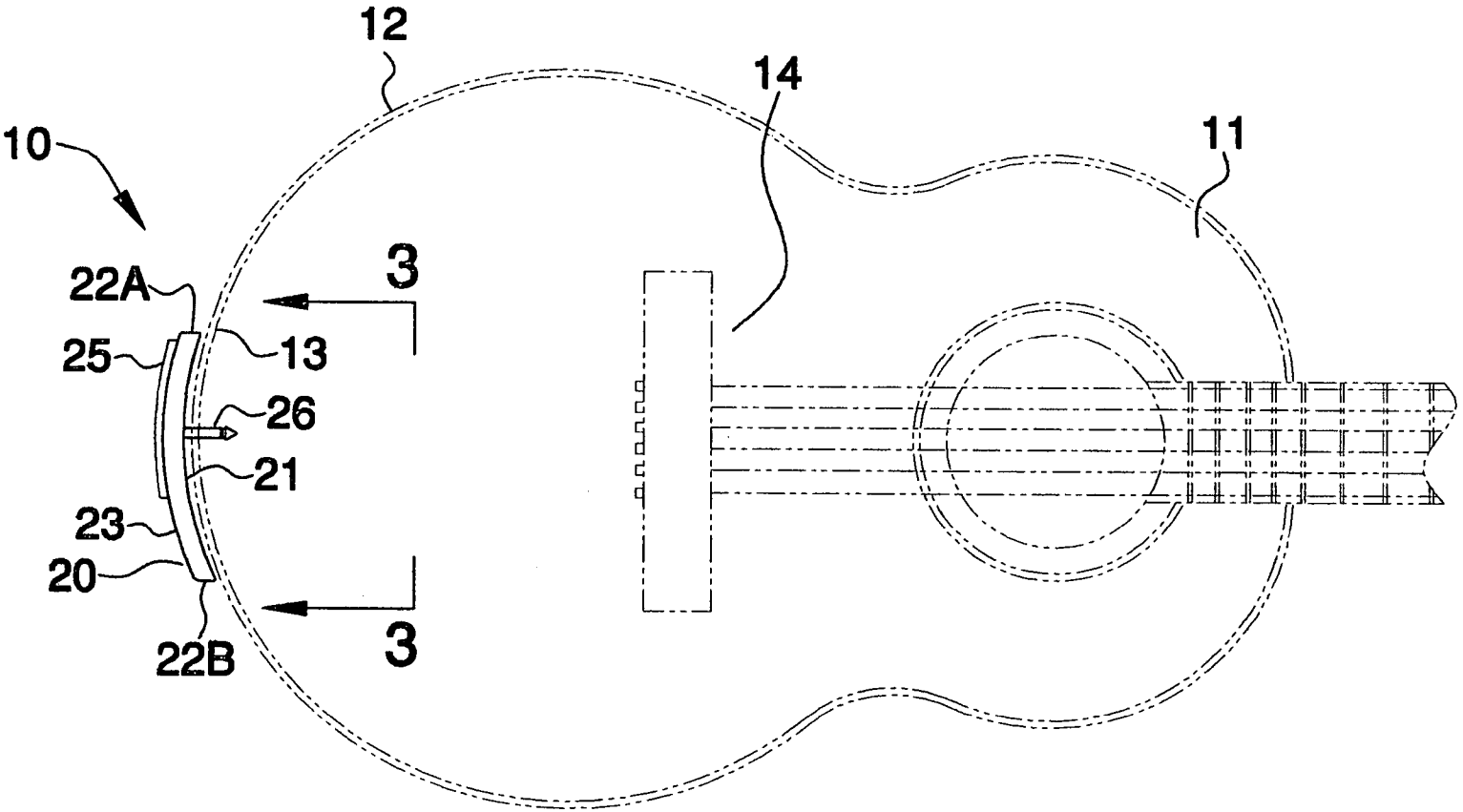
FIG. 2 is a top-plan view of the device shown in FIG. 1.
Figure 3:
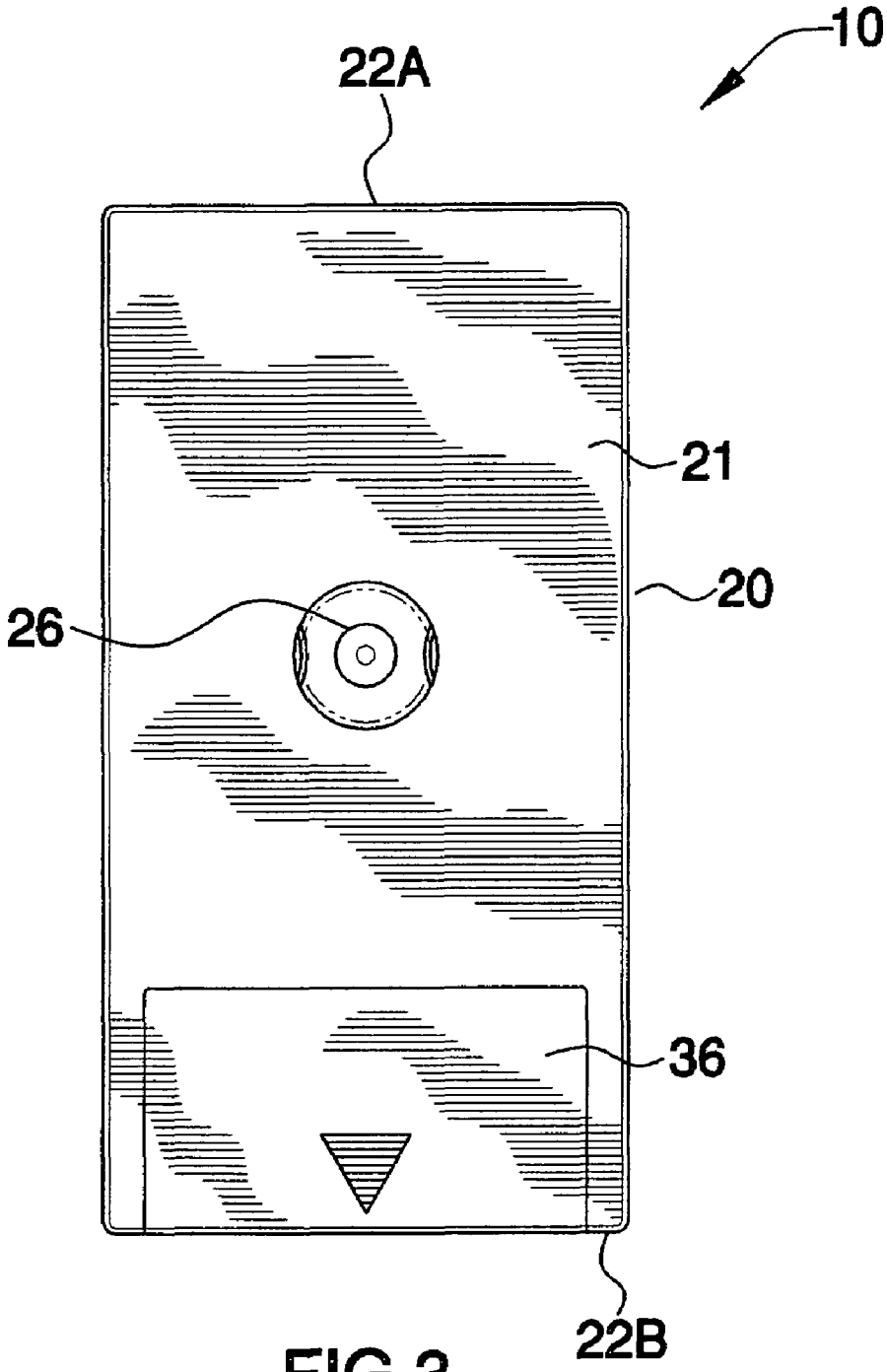
FIG. 3 is a rear-elevational view of the device shown in FIG. 2, taken along line 3-3.
Figure 4:
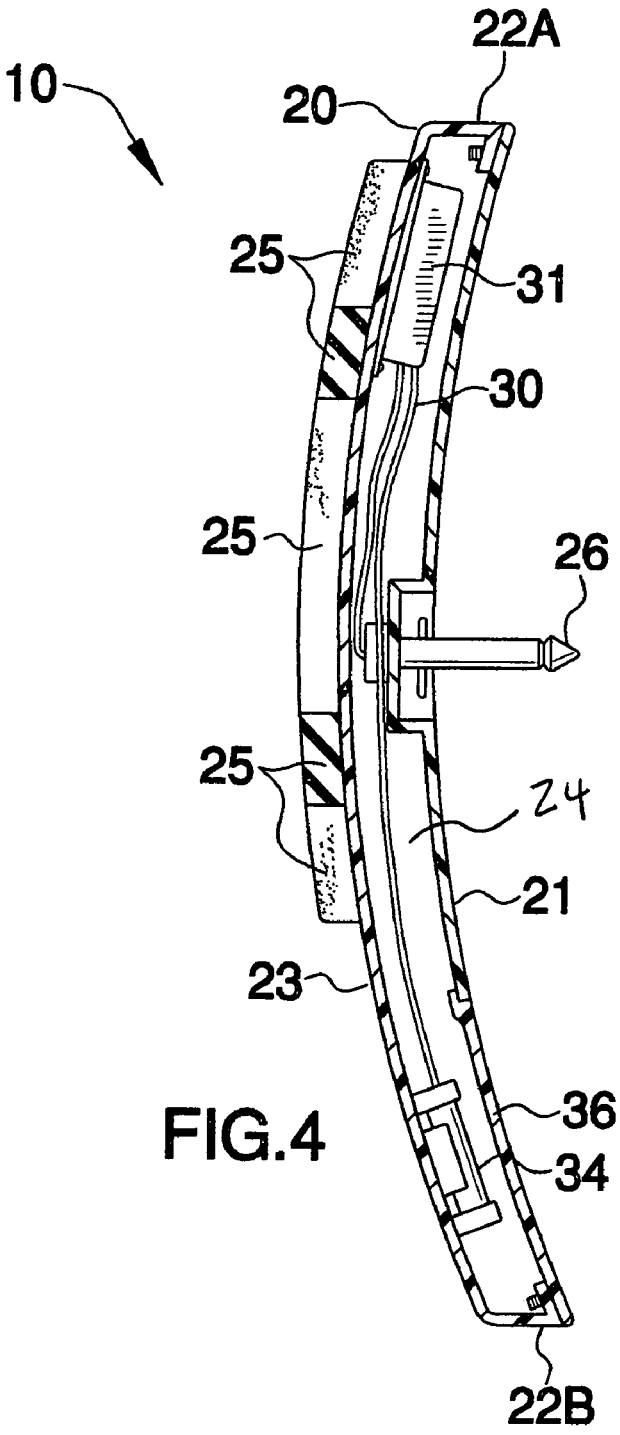
FIG. 4 is a cross-sectional view of the device shown in FIG. 1, taken along line 4-4.

Referring to FIGS. 2 through 4, an electrical contact 26, that has a rectilinear shape, protrudes outwardly from the inner surface 21 such that the electrical contact 26 effectively becomes operably nested with an electromagnetic pickup (not shown) located inside the guitar 11. Such an electrical contact 26 advantageously enables the device 10 to be permanently attached to the guitar 11, thus allowing the user to play and record audio files at any desired time. Positioning the device 10 in such close proximity to the body 14 of the guitar 11 is critical and advantageous for enabling device to record the best possible sound, which is not possible with conventional digital recording devices.

Figure 5:
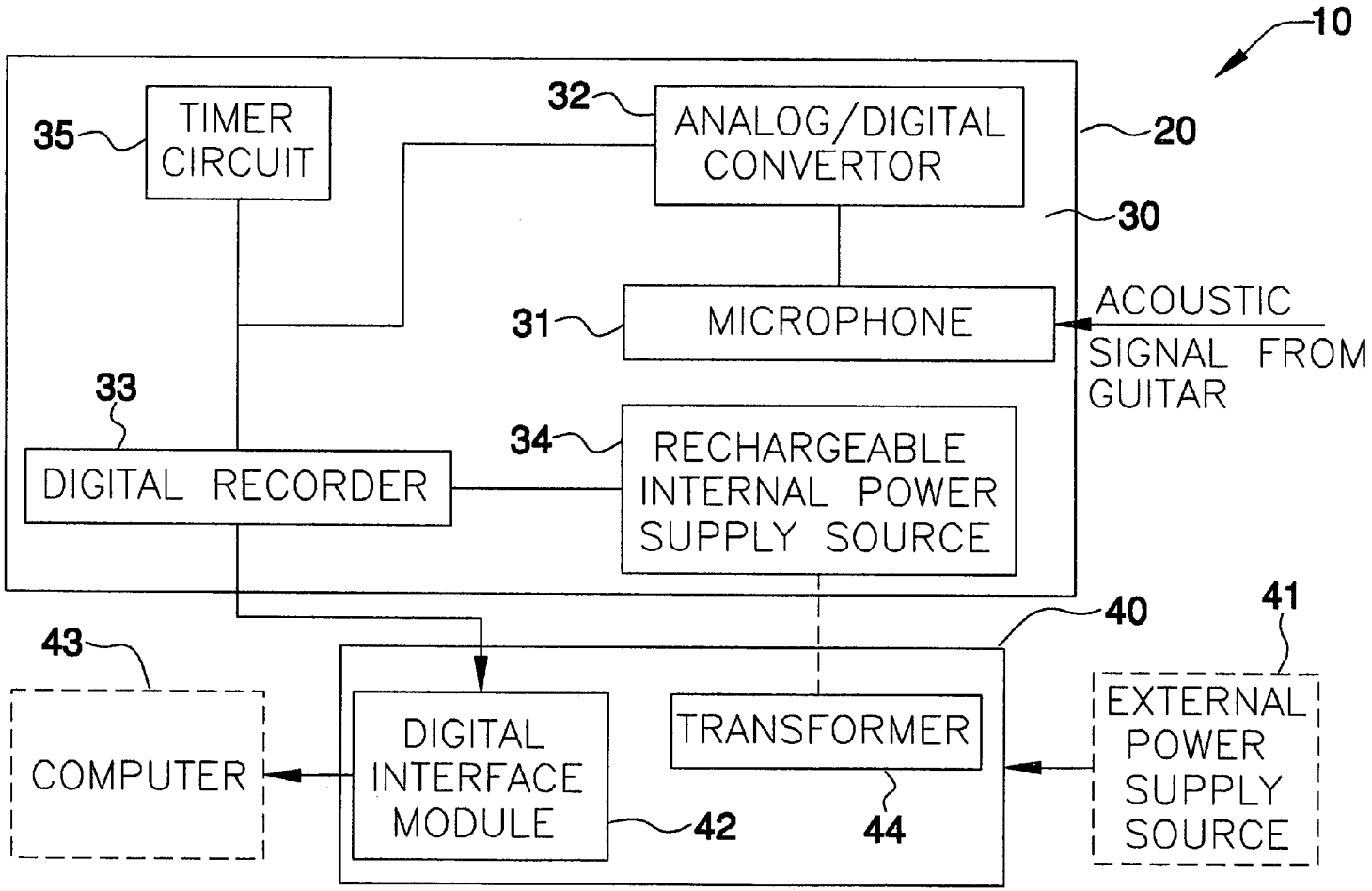
FIG. 5 is a schematic block diagram of the device shown in FIGS. 1 through 4.

Referring to FIGS. 4 and 5, a mechanism 30 is included that is important for digitally recording acoustic signals emanating from the guitar 11 during playing conditions such that the acoustic signals can conveniently be digitally stored into a computer readable file (not shown). The digital recording mechanism 30 is disposed within the arcuate cavity 24. Such a digital recording mechanism 30 includes a microphone 31 directly mated, with no intervening elements, to the electrical contact 26. An analog-to-digital converter 32 is included that is critical for receiving an analog acoustic signal from the microphone 31 and converting the analog acoustic signal to a digital acoustic signal.

A digital recorder 33 is directly linked, with no intervening elements, to the analog-to-digital converter 32. Such a digital recorder 33 is vital for receiving and storing the digital acoustic signal in a single computer readable digital file. The digital recorder 33 includes a MP3 player. Of course, alternate digital recorders may be employed by the device 10, as is obvious to a person of ordinary skill in the art. A rechargeable internal power supply source 34 is directly linked, with no intervening elements, to the digital recording mechanism 30 and situated within the housing 20. The housing 20 is also provided with a convenient access door 36 located on the inner surface 21 thereof, which is necessary for allowing a user to replace the internal power supply source as need arises.

Referring to FIG. 5, a timer circuit 35 is directly and operably mated, with no intervening elements, to the digital recording mechanism 30. Such a timer circuit 35 is essential for automatically toggling the digital recording mechanism 30 between operative and in-operative modes during playing conditions such that the digital recording mechanism 30 advantageously automatically turns on when the player strokes a string on the guitar 11 and automatically turns off after a predetermined time span. This feature advantageously prevents the internal power supply source 34 from being overused, thus allowing the device 10 to be used for extended periods of time.

Again referring to FIG. 5, a portable base station 40 is electrically mateable to an external power supply source 41. Such a base station 40 is directly conjoinable, with no intervening elements, to the housing 20 in such a manner that the base station 40 effectively recharges the internal power supply source 34 during non-operating conditions. The base station 40 further includes a digital interface module 42 operably linked to an external computer 43. Such a digital interface module 42 cooperates with the digital recorder 33 such that the digital file can conveniently be uploaded to the external computer 43 and repeatedly played back as desired by the player.

It is anticipated that the device 10 may be provided with a computer readable program that allows for easy and convenient editing of digitally recorded audio files, which in turn may be recorded onto a compact disc. This feature makes the device 10 extremely appealing to those individuals who do no have access to sufficient funds for paying a recording studio in order to record their music. Also, such a feature of the present invention overcomes conventional shortcomings commonly associated with analog recordings and multi-track recorders, such as poor quality and limited playback capabilities, as well known in the industry. The base station 40 also further includes a transformer 44 electrically coupled to the external power supply source 41 and removably engageable with the internal power supply source 34.

It is further anticipated that the device 10 may be provided with a number of convenient accessories. Such accessories may include a jack/port adapter for allowing the device 10 to be affixed to output jacks on the front of a guitar's body 14, instead of on the lower curve 13. As is obvious, a USB or serial port may also be incorporated into the device 10, thus allowing for transfer of digital data to a computer or laptop via the appropriate cables. Another accessory associated with data transfer that can be provided is that of removable memory cards.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A guitar accessory for recording a player's licks, chords and the like, said guitar accessory comprising:

a housing sized and shaped for being removably engaged directly with a lower curvature of a guitar's frame, said housing including an arcuate inner surface extending between top and bottom ends of said housing, said housing having an arcuate outer surface coextensively shaped with said inner surface and equidistantly spaced therefrom for defining an arcuate cavity within said housing;

an electrical contact having a rectilinear shape protruding outwardly from said inner surface such that said electrical contact becomes operably nested with an electromagnetic pickup located inside the guitar;

a means for digitally recording acoustic signals emanating from the guitar during playing conditions such that said acoustic signals can be digitally stored into a computer readable file, said digital recording means being disposed within said housing;

an internal power supply source directly linked to said digital recording means and situated within said housing;

a timer circuit directly and operably mated to said digital recording means, said timer circuit automatically toggling said digital recording means between operative and in-operative modes during playing conditions such that said digital recording means automatically turns on when the player strokes a string on the guitar and automatically turns off after a predetermined time span; and a portable base station electrically mateable to an external power supply source, said base station being directly conjoinable to said housing in such a manner that said base station recharges said internal power supply source during non-operating conditions.

2. The guitar accessory of claim 1, wherein said digital recording means comprises:

a microphone directly mated to said electrical contact;

an analog-to-digital converter for receiving an analog acoustic signal from said microphone and converting said analog acoustic signal to a digital acoustic signal; and a digital recorder directly linked to said analog-to-digital converter, said digital recorder receiving and storing said digital acoustic signal in a single computer readable digital file.

3. The guitar accessory of claim 2, wherein said base station further comprises:

a digital interface module operably linked to an external computer, said digital interface module cooperating with said digital recorder such that said digital file can be uploaded to the external computer and repeatedly played back as desired by the player.

4. The guitar accessory of claim 2, wherein said digital recorder comprises: a MP3 PLAYER.

5. The guitar accessory of claim 1, said base station further comprising: a transformer electrically coupled to said external power supply source and removably engageable with said internal power supply source.

6. A guitar accessory for recording a player's licks, chords and the like, said guitar accessory comprising:

a housing sized and shaped for being removably engaged directly with a lower curvature of a guitar's frame, said housing including an arcuate inner surface extending between top and bottom ends of said housing, said housing having an arcuate outer surface coextensively shaped with said inner surface and equidistantly spaced therefrom for defining an arcuate cavity within said housing, said housing further comprising: a padded member directly conjoined to said exterior surface of said housing for providing a cushioned barrier between the player and the lower curvature of the guitar;

an electrical contact having a rectilinear shape protruding outwardly from said inner surface such that said electrical contact becomes operably nested with an electromagnetic pickup located inside the guitar;

a means for digitally recording acoustic signals emanating from the guitar during playing conditions such that said acoustic signals can be digitally stored into a computer readable file, said digital recording means being disposed within said housing;

an internal power supply source directly linked to said digital recording means and situated within said housing;

a timer circuit directly and operably mated to said digital recording means, said timer circuit automatically toggling said digital recording means between operative and in-operative modes during playing conditions such that said digital recording means automatically turns on when the player strokes a string on the guitar and automatically turns off after a predetermined time span; and a portable base station electrically mateable to an external power supply source, said base station being directly conjoinable to said housing in such a manner that said base station recharges said internal power supply source during non-operating conditions.

7. The guitar accessory of claim 6, wherein said digital recording means comprises:

a microphone directly mated to said electrical contact;

an analog-to-digital converter for receiving an analog acoustic signal from said microphone and converting said analog acoustic signal to a digital acoustic signal; and a digital recorder directly linked to said analog-to-digital converter, said digital recorder receiving and storing said digital acoustic signal in a single computer readable digital file.

8. The guitar accessory of claim 7, wherein said base station further comprises:

a digital interface module operably linked to an external computer, said digital interface module cooperating with said digital recorder such that said digital file can be uploaded to the external computer and repeatedly played back as desired by the player.

9. The guitar accessory of claim 7, wherein said digital recorder comprises: a MP3 PLAYER.

10. The guitar accessory of claim 6, said base station further comprising: a transformer electrically coupled to said external power supply source and removably engageable with said internal power supply source.

11. A guitar accessory for recording a player's licks, chords and the like, said guitar accessory comprising:

a housing sized and shaped for being removably engaged directly with a lower curvature of a guitar's frame, said housing including an arcuate inner surface extending between top and bottom ends of said housing, said housing having an arcuate outer surface coextensively shaped with said inner surface and equidistantly spaced therefrom for defining an arcuate cavity within said housing, said housing further comprising: a padded member directly conjoined to said exterior surface of said housing for providing a cushioned barrier between the player and the lower curvature of the guitar;

an electrical contact having a rectilinear shape protruding outwardly from said inner surface such that said electrical contact becomes operably nested with an electromagnetic pickup located inside the guitar;

a means for digitally recording acoustic signals emanating from the guitar during playing conditions such that said acoustic signals can be digitally stored into a computer readable file, said digital recording means being disposed within said housing;

a rechargeable internal power supply source directly linked to said digital recording means and situated within said housing;

a timer circuit directly and operably mated to said digital recording means, said timer circuit automatically toggling said digital recording means between operative and in-operative modes during playing conditions such that said digital recording means automatically turns on when the player strokes a string on the guitar and automatically turns off after a predetermined time span; and a portable base station electrically mateable to an external power supply source, said base station being directly conjoinable to said housing in such a manner that said base station recharges said internal power supply source during non-operating conditions.

12. The guitar accessory of claim 11, wherein said digital recording means comprises:

a microphone directly mated to said electrical contact;

an analog-to-digital converter for receiving an analog acoustic signal from said microphone and converting said analog acoustic signal to a digital acoustic signal; and a digital recorder directly linked to said analog-to-digital converter, said digital recorder receiving and storing said digital acoustic signal in a single computer readable digital file.

13. The guitar accessory of claim 12, wherein said base station further comprises:

a digital interface module operably linked to an external computer, said digital interface module cooperating with said digital recorder such that said digital file can be uploaded to the external computer and repeatedly played back as desired by the player.

14. The guitar accessory of claim 12, wherein said digital recorder comprises: a MP3 PLAYER.

15. The guitar accessory of claim 11, said base station further comprising:

a transformer electrically coupled to said external power supply source and removably engageable with said internal power supply source.

* * * * *